US006908490B2

(12) United States Patent
Boeckh et al.

(10) Patent No.: US 6,908,490 B2
(45) Date of Patent: Jun. 21, 2005

(54) USE OF CATIONICALLY MODIFIED, PARTICLE-SHAPED, HYDROPHOBIC POLYMERS AS ADDITION AGENTS IN TEXTILE RINSING OR CARE PRODUCTS AND AS ADDITION AGENTS IN DETERGENTS

(75) Inventors: Dieter Boeckh, Limburgerhof (DE); Ralf Nörenberg, Buettelborn (DE); Sören Hildebrandt, Speyer (DE); Bernhard Mohr, Heidelberg (DE); Holger Schöpke, Neckargemuend (DE); Reinhold J. Leyrer, Dannstadt (DE); Jürgen Huff, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 233 days.

(21) Appl. No.: 10/296,221

(22) PCT Filed: Jun. 2, 2001

(86) PCT No.: PCT/EP01/06312

§ 371 (c)(1),
(2), (4) Date: Dec. 3, 2002

(87) PCT Pub. No.: WO01/94516

PCT Pub. Date: Dec. 13, 2001

(65) Prior Publication Data

US 2003/0171246 A1 Sep. 11, 2003

(30) Foreign Application Priority Data

Jun. 6, 2000 (DE) ..... 100 27 634

(51) Int. Cl.[7] ..... D06M 13/322; D06M 13/46; D06L 1/02; C11D 3/26; C11D 3/37

(52) U.S. Cl. ..... 8/181; 8/188; 8/137; 510/327; 510/330; 510/350; 510/433; 510/504

(58) Field of Search ..... 510/327, 330, 510/350, 433, 504; 8/181, 188, 137

(56) References Cited

U.S. PATENT DOCUMENTS

| | | | | |
|---|---|---|---|---|
| 3,580,853 | A | | 5/1971 | Parran, Jr. |
| 4,746,455 | A | * | 5/1988 | Matsuda et al. ..... 510/337 |
| 2003/0195135 | A1 | | 10/2003 | Boeckh et al. |
| 2004/0077517 | A1 | | 4/2004 | Boeckh et al. |
| 2004/0171515 | A1 | | 9/2004 | Hamers et al. |

FOREIGN PATENT DOCUMENTS

| | | |
|---|---|---|
| DE | 43 23 638 | 1/1995 |
| EP | 0 372 427 | 6/1990 |
| WO | 00 56848 | 9/2000 |

* cited by examiner

*Primary Examiner*—Brian P. Mruk
(74) *Attorney, Agent, or Firm*—Oblon, Spivak, McClelland, Maier & Neustadt, P.C.

(57) ABSTRACT

The invention relates to the use of cationically-modified, particle-shaped, hydrophobic polymers as addition agents in rinsing, care, detergent, and cleaning products. The surface of said polymers is cationically modified by means of a coating of cationic polymers and the particle size of said polymers ranges from 10 nm to 100 $\mu$m.

17 Claims, No Drawings

USE OF CATIONICALLY MODIFIED, PARTICLE-SHAPED, HYDROPHOBIC POLYMERS AS ADDITION AGENTS IN TEXTILE RINSING OR CARE PRODUCTS AND AS ADDITION AGENTS IN DETERGENTS

The invention relates to the use of cationically modified, particulate, hydrophobic polymers as additive to rinse or care compositions and as additive to detergents, and also to rinse compositions, care compositions and detergents which comprise the cationically modified, particulate, hydrophobic polymers.

Dispersions of particles of hydrophobic polymers, in particular aqueous dispersions of synthetic polymers and of waxes are used in the art for modifying the properties of surfaces. For example, aqueous dispersions of finely divided hydrophobic polymers are used as binders in paper coating slips for the coating of paper, or as coating compositions. The dispersions applied in each case to a substrate in accordance with customary methods, e.g. by knifecoating, painting, saturation or impregnation, are dried. During this, the dispersely distributed particles form a continuous film on the respective surface.

Aqueous washing, rinsing, cleaning and care processes are, by constrast, usually carried out in a heavily diluted liquor, where the ingredients of the formulation used in each case do not remain on the substrate, but instead are disposed of with the wastewater. Modification of surfaces with dispersed hydrophobic particles is possible in the abovementioned processes only to an entirely unsatisfactory degree. Thus, for example, U.S. Pat. No. 3,580,853 discloses a detergent formulation which comprises a water-insoluble finely divided substance, such as biocides and certain cationic polymers which increase the deposition and retention of the biocides on the surface of the ware.

Furthermore, U.S. Pat. No. 5,476,660 discloses the principle of using polymeric retention agents for cationic or zwitterionic dispersions of polystyrene or wax which contain an active substance embedded within the dispersed particles. These dispersed particles are referred to as "carrier particles", because they adhere to the treated surface, where they release the active substance e.g. upon use in surfactant-containing formulations.

U.S. Pat. No. 3,993,830 discloses the application of a nonpermanent soil repellant finish on a textile ware by treating the textile ware with a diluted aqueous solution which comprises a polycarboxylate polymer and a water-soluble salt of a polyvalent metal. Suitable polycarboxylate polymers are, preferably, water-soluble copolymers of ethylenically unsaturated monocarboxylic acids and alkyl acrylates. The mixtures are used, in the case of domestic textile washing, in the rinse cycle of the washing machine.

It is an object of the present invention to provide a further method for the modification of textile surfaces.

We have found that this object is achieved according to the invention by the use of cationically modified, particulate, hydrophobic polymers, the surface of which has been cationically modified by coating with cationic polymers, and the particle size of which is 10 nm to 100 $\mu$m, as additive to rinse or care compositions for textiles and as additive to detergents.

The cationically modified, particulate, hydrophobic polymers are obtainable, for example, by treatment of aqueous dispersions of particulate, hydrophobic polymers having a particle size of from 10 nm to 100 $\mu$m with an aqueous solution or dispersion of a cationic polymer. This is carried out most simply by combining an aqueous dispersion of particulate, hydrophobic polymers having a particle size of from 10 nm to 100 $\mu$m with an aqueous solution or dispersion of a cationic polymer. The cationic polymers are preferably used in the form of aqueous solutions, but it is also possible to use aqueous dispersions of cationic polymers, the dispersed particles of which have an average diameter up to 1 $\mu$m. In most cases, the two components are mixed at room temperature, although the mixing can also be carried out at temperatures of e.g. 0° to 100° C., provided that the dispersions do not coagulate upon heating.

The dispersions of the particulate, hydrophobic polymers can be stabilized using an anionic emulsifier or protective colloid. Other dispersions which can be used with equal success are free from protective colloids and emulsifiers and comprise, however, for this purpose as hydrophobic polymers, copolymers which contain at least one anionic monomer in copolymerized form. Such dispersions of copolymers having anionic groups may optionally additionally comprise an emulsifier and/or a protective colloid. Preference is given here to using anionic emulsifiers and/or protective colloids.

In the treatment of the anionically adjusted dispersions of the hydrophic polymers with an aqueous solution of a cationic polymer, the charge of the originally anionically dispersed particles is reversed so that, following the treatment, they preferably carry a cationic charge. Thus, for example, cationically modified dispersions of particulate, hydrophobic polymers have, in 0.1% strength by weight aqueous dispersion, an interface potential of −5 to +50 mV, preferably from −2 to +25 mV, in particular from 0 to +15 mV. The interface potential is determined by measuring the electrophoretic mobility in dilute aqueous dispersion and the pH of the designated application liquor.

The pH of the aqueous dispersions of the cationically modified, particulate, hydrophobic polymers is, for example, 1 to 12 and is preferably in the range from 2 to 10, in particular in the range from 2.5 to 8. If particles of the polymers having a content of more than 10% by weight of anionic monomers are used, the pH of the aqueous dispersions is 1 to 7.5, preferably 2 to 5.5, in particular 2.5 to 5.

The hydrophobic polymers used according to the invention are insoluble in water at the application pH. They are present therein in the form of particles having an average particle size of 10 nm to 100 $\mu$m, preferably 25 nm to 20 $\mu$m, particularly preferably 40 nm to 2 $\mu$m and in particular 60 to 800 nm, and can be obtained from the aqueous dispersions as powders. The average particle size of the hydrophobic polymers can be determined, for example, under the electron microscope or using light scattering experiments.

In a preferred embodiment, the particles of the hydrophobic polymers to be used according to the invention exhibit pH-dependent solubility and swelling behavior. At a pH below 6.5, particularly below 5.5 and in particular below 5, the particles are water-insoluble and retain their particular character upon dispersion in concentrated and also in dilute aqueous media. By contrast, hydrophobic polymer particles containing carboxyl groups swell in water under neutral and alkaline conditions. This behavior of hydrophobic polymers having anionic groups is known from the literature, cf. M. Siddiq et al., who, in Colloid. Polym. Sci. 277, 1172–1178 (1999), report on the behavior of particles of methacrylic acid/ethyl acrylate copolymers in an aqueous medium.

Hydrophobic polymers are obtainable, for example, by polymerization of monomers from the group of alkyl esters of $C_3$–$C_5$-monoethylenically unsaturated carboxylic acids and monohydric $C_1$–$C_{22}$-alcohols, hydroxyalkyl esters of $C_3$–$C_5$-monoethylenically unsaturated carboxylic acids and dihydric $C_2$–$C_4$-alcohols, vinyl esters of saturated $C_1$–$C_{18}$-carboxylic acids, ethylene, propylene, isobutylene, $C_4$–$C_{24}$-α-olefins, butadiene, styrene, α-methylstyrene, acrylonitrile, methacrylonitrile, tetrafluoroethylene, vinylidene fluoride, fluoroethylene, chlorotrifluoroethylene, hexafluoropropene, esters or amides of $C_3$–$C_5$-monoethylenically unsaturated carboxylic acids with amines or alcohols containing perfluoroalkyl groups, alkyl and vinyl esters of carboxylic acids containing perfluoroalkyl groups or mixtures thereof. These may be homopolymers or copolymers.

Examples of hydrophobic copolymers are copolymers of ethyl acrylate and vinyl acetate, copolymers of butyl acrylate and styrene, copolymers of (meth)acrylic esters of the perfluoroalkyl-substituted alcohols of the formula $CF_3$—$(C_2F_4)_n$—$(CH_2)_m$—OH or $C_2F_5$—$(C_2F_4)_n$—$(CH_2)_m$—OH (n=1–10, m=0–10) with (meth)acrylic esters and/or (meth) acrylic acid, copolymers of ethylene and tetrafluoroethylene, and copolymers of butyl acrylate and vinyl acetate. Said copolymers can contain the monomers in copolymerized form in any ratios.

The anionic character of the polymers mentioned can be achieved, for example, by copolymerizing the monomers which form the basis of the copolymers in the presence of small amounts of anionic monomers such as acrylic acid, methacrylic acid, styrenesulfonic acid, acrylamido-2-methyl-propanesulfonic acid, vinyl sulfonate and/or maleic acid and optionally in the presence of emulsifiers and/or protective colloids.

The anionic character of the mentioned polymers can, however, also be achieved by carrying out the copolymerization in the presence of anionic protective colloids and/or anionic emulsifiers.

The anionic character of the mentioned polymers can, however, also be achieved by emulsifying or dispersing the finished polymers in the presence of anionic protective colloids and/or anionic emulsifiers.

Hydrophobic polymers comprise, for example, (a) 40 to 100% by weight, preferably 50 to 90% by weight, particularly preferably 60 to 75% by weight, of at least one water-insoluble nonionic monomer, (b) 0 to 60% by weight, preferably 1 to 55% by weight, particularly preferably 5 to 50% by weight, in particular 15 to 40% by weight, of at least one monomer containing carboxyl groups or salts thereof, (c) 0 to 25% by weight, preferably 0 to 15% by weight, of a monomer containing sulfonic acid and/or phosphonic acid groups, or salts thereof, (d) 0 to 55% by weight, preferably 0 to 40% by weight, of at least one water-soluble nonionic monomer and (e) 0 to 10% by weight, preferably 0 to 5% by weight, of at least one polyethylenically unsaturated monomer in copolymerized form.

Polymers which contain at least one anionic monomer b) or c) can be used without additional anionic emulsifiers or protective colloids. Polymers which contain less than 0.5% of anionic monomers are in most cases used together with at least one anionic emulsifer and/or protective colloid.

Preferred monomers (a) are methyl acrylate, ethyl acrylate, n-butyl acrylate, sec-butyl acrylate, tert-butyl acrylate, ethylhexyl acrylate, hydroxyethyl acrylate, hydroxypropyl acrylate, methyl methacrylate, n-butyl methacrylate, (meth)acrylic esters of the perfluoroalkyl-substituted alcohols $CF_3$—$(C_2F_4)_n$—$(CH_2)_m$—OH or $C_2F_5$—$(C_2F_4)_n$—$(CH_2)_m$—OH (n=2–8, m is 1 or 2), vinyl acetate, vinyl propionate, styrene, ethylene, propylene, butylene, isobutene, diisobutene and tetrafluoroethylene, and particularly preferred monomers (a) are methyl acrylate, ethyl acrylate, n-butyl acrylate, tert-butyl acrylate and vinyl acetate.

Preferred hydrophobic polymers contain less than 75% by weight of a nonionic water-insoluble monomer (a) in copolymerized form, the homopolymers of which have a glass transition temperature $T_g$ of more than 60° C.

Preferred monomers (b) are acrylic acid, methacrylic acid, maleic acid or maleic half-esters of $C_1$–$C_8$-alcohols.

Monomers of group (c) are, for example, acrylamido-2-methylpropanesulfonic acid, vinylsulfonic acid, methallylsulfonic acid, vinylsulfonic acid, and the alkali metal and ammonium salts of these monomers.

Suitable monomers (d) are, for example, acrylamide, methacrylamide, N-vinylformamide, N-vinylacetamide, N-vinylpyrrolidone, N-vinyloxazolidone, methylpolyglycol acrylate, methylpolyglycol methacrylate and methylpolyglycol acrylamide. Preferred monomers (d) are vinylpyrrolidone, acrylamide and N-vinylformamide.

Suitable polyethylenically unsaturated monomers (e) are, for example, acrylic esters, methacrylic esters, allyl ethers or vinyl ethers of at least dihydric alcohols. The OH groups of the parent alcohols can be completely or partially etherified or esterified; however, the crosslinkers contain at least two ethylenically unsaturated groups. Examples are butanediol diacrylate, hexanediol diacrylate, trimethylolpropane triacrylate and tripropylene glycol diacrylate.

Further suitable polyethylenically unsaturated monomers (e) are e.g. allyl esters of unsaturated carboxylic acids, divinylbenzene, methylenebisacrylamide and divinylurea.

Such copolymers can be prepared by the known methods of solution, precipitation, suspension or emulsion polymerization of the monomers using free-radical polymerization initiators. Preferably, the particulate hydrophobic polymers are obtained by the process of emulsion polymerization in water. The polymers have, for example, molar masses of from 1000 to 2 million, preferably from 5000 to 500 000, and in most cases the molar masses of the polymers are in the range from 10 000 to 150 000.

To limit the molar masses of the polymers it is possible to add customary regulators during the polymerization. Examples of typical regulators are mercapto compounds, such as mercaptoethanol or thioglycolic acid.

Apart from said polymerization processes, other processes for the preparation of the polymer particles to be used according to the invention are also suitable. Thus, it is possible, for example, to precipitate out polymers by lowering the solubility of the polymers in the solvent. Such a method consists, for example, in dissolving a copolymer containing acid groups in a suitable water-miscible solvent, and metering in water in an excess such that the pH of the initial charge is lower by at least 1 than the equivalent pH of the copolymer. Equivalent pH is understood as meaning the pH at which 50% of the acidic groups of the copolymer have been neutralized. In this process, it may be necessary to add dispersion auxiliaries, pH regulators and/or salts in order to obtain stable finely divided dispersions.

For the modification of finely divided hydrophobic polymers to be used according to the invention which contain anionic groups, it is possible to additionally add, during the dispersion, other polymers which partially or completely react or associate therewith and precipitate out. Such polymers are, for example, polysaccharides, polyvinyl alcohols and polyacrylamides.

Particulate, hydrophobic polymers can also be prepared by emulsifying a melt of the hydrophobic polymers in a controlled manner. For this, the polymer or a mixture of the polymers with further additives is, for example, melted and, under the action of strong shear forces, e.g. in an Ultra-Turrax, water is metered in in an excess such that the pH of the initial charge is lower by at least one than the equivalent pH of the polymer. Here, it may in some instances be necessary to add emulsifying auxiliaries, pH regulators and/or salts in order to obtain stable finely divided dispersions. Also in the case of this variant of the preparation of finely divided polymer dispersions, it is possible to co-use additional polymers such as polysaccharides, polyvinyl alcohols or polyacrylamides, particularly when the hydrophobic polymer contains anionic groups.

A further method for the preparation of finely divided hydrophobic polymers which contain anionic groups consists in treating aqueous, alkaline solutions of the polymers, preferably under the action of strong shear forces, with an acid.

Examples of anionic emulsifiers are anionic surfactants and soaps. Anionic surfactants which may be used are alkyl and alkenyl sulfates, sulfonates, phosphates and phosphonates, alkyl- and alkenylbenzenesulfonates, alkyl ether sulfates and phosphates, saturated and unsaturated $C_{10}$–$C_{25}$-carboxylic acids and salts thereof.

Additionally, it is possible to use nonionic and/or betainic emulsifiers. A description of suitable emulsifiers is given, for example, in Houben Weyl, Methoden der organischen Chemie [Methods of organic Chemistry], Volume XIV/1, Makromolekulare Stoffe [Macromolecular Substances], Georg Thieme Verlag, Stuttgart, 1961, pages 192 to 208.

Examples of anionic protective colloids are water-soluble anionic polymers. Here, it is possible to use very different types of polymer. Anionically substituted polysaccharides and/or water-soluble anionic copolymers of acrylic acid, methacrylic acid, maleic acid, maleic half-esters, vinylsulfonic acid, styrenesulfonic acid or acrylamidopropanesulfonic acid are preferably used with other vinylic monomers. Suitable anionically substituted polysaccharides are, for example, carboxymethylcellulose, carboxymethyl starch, oxidized starch, oxidized cellulose and other oxidized polysaccharides, and the corresponding derivatives of the partially degraded polysaccharide.

Suitable water-soluble anionic copolymers are, for example, copolymers of acrylic acid with vinyl acetate, acrylic acid with ethylene, acrylic acid with acrylamide, acrylamidopropanesulfonic acid with acrylamide or acrylic acid with styrene.

Other nonionic and/or betainic protective colloids can additionally be used. An overview of customarily used protective colloids is given in Houben Weyl, Methoden der organischen Chemie, Volume XIV/1, Makromolekulare Stoffe, Georg Thieme Verlag, Stuttgart, 1961, pages 411 to 420.

For the preparation of particulate, hydrophobic polymers use is preferably made of anionic polymeric protective colloids which lead to primary particles having anionic groups on the particle surface.

The cationically modified, particulate, hydrophobic polymers to be used according to the invention are obtainable by coating the surface of the anionically dispersed, particulate, hydrophobic polymers with cationic polymers. Cationic polymers which can be used are all cationic synthetic polymers which are soluble or finely dispersible in aqueous solvents and which contain amino and/or ammonium groups. Examples of such cationic polymers are polymers containing vinylamine units, polymers containing vinylimidazole units, polymers containing quaternary vinylimidazole units, condensates of imidazole and epichlorohydrin, crosslinked polyamidoamines, crosslinked polyamidoamines grafted with ethylenimine, polyethylenimines, alkoxylated polyethylenimines, crosslinked polyethylenimines, amidated polyethylenimines, alkylated polyethylenimines, polyamines, amine/epichlorohydrin polycondensates, alkoxylated polyamines, polyallylamines, polydimethyldiallylammonium chlorides, polymers containing basic (meth) acrylamide or (meth)acrylic ester units, polymers containing basic quaternary (meth)acrylamide or (meth)acrylic ester units, and/or lysine condensates.

For the preparation of polymers containing vinylamine units, the starting materials are, for example, open-chain N-vinylcarboxamides of the formula:

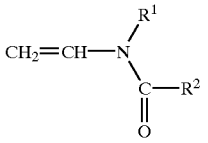

(I)

in which $R^1$ and $R^2$ may be identical or different and are hydrogen and $C_1$–$C_6$-alkyl. Suitable monomers are, for example, N-vinylformamide ($R^1$=$R^2$=H in formula I), N-vinyl-N-methylformamide, N-vinylacetamide, N-vinyl-N-methylacetamide, N-vinyl-N-ethyl-acetamide, N-vinyl-N-methylpropionamide and N-vinylpropionamide. For the preparation of the polymers, said monomers can be polymerized alone, in mixtures with one another or together with other monoethylenically unsaturated monomers. Preference is given to starting from homopolymers or copolymers of N-vinylformamide. Polymers containing vinylamine units are known, for example, from U.S. Pat. No. 4,421,602, EP-A-0 216 387 and EP-A-0 251 182. They are obtained by hydrolysis of polymers which contain the monomers of the formula I in copolymerized form, with acids, bases or enzymes.

Suitable monoethylenically unsaturated monomers which are copolymerized with the N-vinylcarboxamides are all compounds copolymerizable therewith. Examples thereof are vinyl esters of saturated carboxylic acids having 1 to 6 carbon atoms, such as vinyl formate, vinyl acetate, vinyl propionate and vinyl butyrate, and vinyl ethers, such as $C_1$–$C_6$-alkyl vinyl ethers, e.g. methyl or ethyl vinyl ethers. Further suitable comonomers are ethylenically unsaturated $C_3$–$C_6$-carboxylic acids, for example acrylic acid, methacrylic acid, maleic acid, crotonic acid, itaconic acid and vinyl acetic acid, and the alkali metal and alkaline earth metal salts thereof, esters, amides and nitrites of said carboxylic acids, for example methyl acrylate, methyl methacrylate, ethyl acrylate and ethyl methacrylate.

Cationic polymers are also understood as meaning amphoteric polymers which have a net cationic charge, i.e. the polymers contain both anionic and cationic monomers in copolymerized form, although the molar proportion of the cationic units present in the polymer is greater than that of the anionic units.

Further suitable carboxylic esters are derived from glycols or polyalkylene glycol, where in each case only one OH group is esterified, e.g. hydroxyethyl acrylate, hydroxyethyl methacrylate, hydroxypropyl acrylate, hydroxybutyl acrylate, hydroxypropyl methacrylate, hydroxybutyl methacrylate, and acrylic monoesters of polyalkylene glycols having a molar mass of from 500 to 10 000. Further suitable comonomers are esters of ethylenically unsaturated carboxylic acids with amino alcohols, such as, for example, dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, dimethylaminobutyl acrylate and diethylaminobutyl acrylate. The basic acrylates can be used in the form of the free bases, the salts with mineral acids, such as hydrochloric acid, sulfuric acid or nitric acid, the salts with organic acids, such as formic acid, acetic acid, propionic acid or of the sulfonic acids or in quaternized form. Suitable quaternizing agents are, for example, dimethyl sulfate, diethyl sulfate, methyl chloride, ethyl chloride or benzyl chloride.

Further suitable comonomers are amides of ethylenically unsaturated carboxylic acids, such as acrylamide, methacrylamide, and N-alkylmono- and diamides of monoethylenically unsaturated carboxylic acids having alkyl radicals of 1 to 6 carbon atoms, e.g. N-methylacrylamide, N,N-dimethylacrylamide, N-methylmethacrylamide, N-ethylacrylamide, N-propylacrylamide and tert-butylacrylamide, and basic (meth)acrylamides, such as dimethylaminoethylacrylamide, dimethylaminoethylmethacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide.

Also suitable as comonomers are N-vinylpyrrolidone, N-vinyl-caprolactam, acrylonitrile, methacrylonitrile, N-vinylimidazole and substituted N-vinylimidazoles, such as e.g. N-vinyl-2-methyl-imidazole, N-vinyl-4-methylimidazole, N-vinyl-5-methylimidazole, N-vinyl-2-ethylimidazole and N-vinylimidazolines, such as N-vinylimidazoline, N-vinyl-2-methylimidazoline and N-vinyl-2-ethylimidazoline. Apart from being used in the form of the free bases, N-vinylimidazoles and N-vinylimidazolines can also be used in a form neutralized with mineral acids or organic acids or in quaternized form, the quaternization preferably being effected using dimethyl sulfate, diethyl sulfate, methyl chloride or benzyl chloride. Also suitable are diallyldialkylammonium halides, such as diallyldimethylammonium chloride.

Further suitable comonomers are monomers containing sulfo groups, such as, for example, vinylsulfonic acid, allylsulfonic acid, methallylsulfonic acid, styrenesulfonic acid, the alkali metal or ammonium salts of these acids or 3-sulfopropyl acrylate, the content in the amphoteric copolymers of cationic units exceeding the content of anionic units, such that overall the polymers have a cationic charge.

The copolymers comprise, for example, 99.99 to 1 mol %, preferably 99.9 to 5 mol % of N-vinylcarboxamides of the formula I and 0.01 to 99 mol %, preferably 0.1 to 95 mol % of other monoethylenically unsaturated monomers copolymerizable therewith in copolymerized form.

To prepare polymers containing vinylamine units, preference is given to starting from homopolymers of N-vinylformamide or of copolymers obtainable by copolymerization of N-vinylformamide with vinyl formate, vinyl acetate, vinyl propionate, acrylonitrile, N-vinylcaprolactam, N-vinylurea, acrylic acid, N-vinylpyrrolidone or $C_1$–$C_6$-alkyl vinyl ethers and subsequent hydrolysis of the homopolymers or of the copolymers with the formation of vinylamine units from the copolymerized N-vinylformamide units, the degree of hydrolysis being, for example, 0.1 to 100 mol %.

The hydrolysis of the above-described polymers is carried out in accordance with known processes by the action of acids, bases or enzymes. In this process, the copolymerized monomers of the above formula I produce, as a result of cleaving off the group:

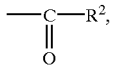

(II)

where $R^2$ has the meaning given therefor in formula I, polymers which contain vinylamine units of the formula:

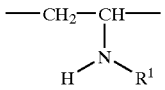

(III)

in which $R^1$ has the meaning given in formula I. If acids are used as hydrolysis agents, the units III are in the form of the ammonium salt.

The homopolymers of the N-vinylcarboxamides of the formula I and their copolymers can be hydrolyzed to 0.1 to 100 mol %, preferably 70 to 100 mol %. In most cases, the degree of hydrolysis of the homopolymers and copolymers is 5 to 95 mol %. The degree of hydrolysis of the homopolymers is synonymous with the content of vinylamine units in the polymers. In the case of copolymers which contain vinyl esters in copolymerized form, in addition to the hydrolysis of the N-vinylformamide units, hydrolysis of the ester groups can arise with the formation of vinyl alcohol units. This is the case particularly when the hydrolysis of the copolymers is carried out in the presence of sodium hydroxide solution. Copolymerized acrylonitrile is likewise chemically changed during the hydrolysis. Here, amide groups or carboxyl groups, for example, form. The homopolymers and copolymers containing vinylamine units may optionally contain up to 20 mol % of amidine units, which are formed, for example, by the reaction of formic acid with two adjacent amino groups or by intramolecular reaction of one amino group with an adjacent amide group e.g. of copolymerized N-vinylformamide. The molar masses of the polymers containing vinylamine units are, for example, 1000 to 10 million, preferably 10 000 to 5 million (determined by light scattering). This molar mass range corresponds, for example, to K values of from 5 to 300, preferably 10 to 250 (determined in accordance with H. Fikentscher in 5% strength aqueous sodium chloride solution at 25° C. and a polymer concentration of 0.5% by weight).

The polymers containing vinylamine units are preferably used in salt-free form. Salt-free aqueous solutions of polymers containing vinylamine units can be prepared, for example, from the above-described salt-containing polymer solutions using ultrafiltration over suitable membranes at cut-offs of, for example, 1000 to 500 000 daltons, preferably 10 000 to 300 000 daltons. The aqueous solutions of other polymers containing amino and/or ammonium groups described below can also be obtained in salt-free form by means of ultrafiltration.

Polyethylenimines are prepared, for example, by polymerization of ethylenimine in aqueous solution in the presence of acid-eliminating compounds, acids or Lewis acids. Polyethylenimines have, for example, molar masses up to 2 million, preferably from 200 to 500 000. Particular preference is given to using polyethylenimines having molar masses of from 500 to 100 000. Also suitable are water-soluble, crosslinked polyethylenimines which are obtainable by reacting polyethylenimines with crosslinkers, such as epichlorohydrin or bischlorohydrin ethers of polyalkylene glycols having 2 to 100 ethylene oxide and/or propylene oxide units. Amidic polyethylenimines which are obtainable, for example, by amidation of polyethylenimines with $C_1$–$C_{22}$-monocarboxylic acids are also suitable. Further suitable cationic polymers are alkylated polyethylenimines and alkoxylated polyethylenimines. During the alkoxylation, 1 to 5 ethylene oxide or propylene oxide units are used, for example, per NH unit in polyethylenimine.

Further suitable amino- and/or ammonium-containing polymers are polyamidoamines, which are obtainable, for example, by condensing dicarboxylic acids with polyamines. Suitable polyamidoamines are obtained, for example, by reacting dicarboxylic acids having 4 to 10 carbon atoms with polyalkylenepolyamines which contain 3 to 10 basic nitrogen atoms in the molecule. Suitable dicarboxylic acids are, for example, succinic acid, maleic acid, adipic acid, glutaric acid, suberic acid, sebacic acid and terephthalic acid. In the preparation of the polyamidoamines it is also possible to use mixtures of dicarboxylic acids as well as mixtures of two or more polyalkylenepolyamines. Examples of suitable polyalkylenepolyamines are diethylenetriamine, triethylenetetramine, tetraethylenepentamine, dipropylenetriamine, tripropylenetetramine, dihexamethylenetriamine, aminopropylethylenediamine and bisaminopropylethylenediamine. For the preparation of the polyamido amines, the dicarboxylic acids and polyalkylenepolyamines are heated to relatively high temperatures, e.g. to temperatures in the range from 120 to 220, preferably 130 to 180° C. The water which forms during the condensation is removed from the system. Lactones or lactams of carboxylic acids having 4 to 8 carbon atoms may also be used in the condensation. 0.8 to 1.4 mol of a polyalkylenepolyamine, for example, are used per mole of dicarboxylic acid.

Further amino-containing polymers are polyamidoamines grafted with ethylenimine. They are obtainable from the above-described polyamidoamines by reaction with ethylenimine in the presence of acids or Lewis acids, such as sulfuric acid or boron trifluoride etherates, at temperatures of, for example, 80 to 100° C. Compounds of this type are described, for example, in DE-B-24 34 816.

The optionally crosslinked polyamidoamines, which have optionally been additionally grafted with ethylenimine prior to crosslinking, are also suitable as cationic polymers. The crosslinked polyamidoamines grafted with ethylenimine are water-soluble and have, for example, an average molecular weight of from 3000 to 1 million daltons. Customary crosslinkers are, for example, epichlorohydrin or bischlorohydrin ethers of alkylene glycols and polyalkylene glycols.

Further examples of cationic polymers which contain amino and/or ammonium groups are polydiallyldimethylammonium chlorides. Polymers of this type are likewise known.

Further suitable cationic polymers are copolymers of, for example, 1 to 99 mol %, preferably 30 to 70 mol % of acrylamide and/or methacrylamide and 99 to 1 mol %, preferably 70 to 30 mol % of cationic monomers, such as dialkylaminoalkylacrylamide, dialkylaminoalkylacrylic esters and/or dialkylaminoalkylmethacrylamide and/or dialkylaminoalkylmethacrylic esters. The basic acrylamides and methacrylamides are likewise preferably in a form neutralized with acids or in quaternized form. Examples which may be mentioned are N-trimethylammoniumethylacrylamide chloride, N-trimethylammoniumethylmethacrylamide chloride, N-trimethylammoniumethyl methacrylate chloride, N-trimethylammoniumethyl acrylate chloride, trimethylammoniumethylacrylamide methosulfate, trimethylammoniumethylmethacrylamide methosulfate, N-ethyldimethylammoniumethylacrylamide ethosulfate, N-ethyldimethylammoniumethylmethacrylamide ethosulfate, trimethylammoniumpropylacrylamide chloride, trimethylammoniumpropylmethacrylamide chloride, trimethylammoniumpropylacrylamide methosulfate, trimethylammoniumpropylmethacrylamide methosulfate and N-ethyldimethylammoniumpropylacrylamide ethosulfate. Preference is given to trimethylammoniumpropylmethacrylamide chloride.

Further suitable cationic monomers for the preparation of (meth)acrylamide polymers are diallyldimethylammonium halides and basic (meth)acrylates. Suitable examples are copolymers of 1 to 99 mol %, preferably 30 to 70 mol %, of acrylamide and/or methacrylamide and 99 to 1 mol %, preferably 70 to 30 mol %, of dialkylaminoalkyl acrylates and/or methacrylates, such as copolymers of acrylamide and N,N-dimethylaminoethyl acrylate or copolymers of acrylamide and dimethylaminopropyl acrylate. Basic acrylates or methacrylates are preferably in a form neutralized with acids or in quaternized form. The quaternization can be carried out, for example, with methyl chloride or with dimethyl sulfate.

Further suitable cationic polymers which have amino and/or ammonium groups are polyallylamines. Polymers of this type are obtained by homopolymerization of allylamine, preferably in a form neutralized with acids or in quaternized form, or by a copolymerization of allylamine with other monoethylenically unsaturated monomers which are described above as comonomers for N-vinylcarboxamides.

The cationic polymers have, for example, K values of from 8 to 300, preferably 100 to 180 (determined in accordance with H. Fikentscher in 5% strength aqueous sodium chloride solution at 25° C. and a polymer concentration of 0.5% by weight). At a pH of 4.5, they have, for example, a charge density of at least 1, preferably at least 4 meq/g of polyelectrolyte.

Examples of preferred cationic polymers are polydimethyldiallylammonium chloride, polyethylenimine, polymers containing vinylamine units, copolymers of acrylamide or methacrylamide, containing basic monomers in copolymerized form, polymers containing lysine units, or mixtures thereof. Examples of cationic polymers are:

Copolymers of 50 mol % vinylpyrrolidone and 50 mol % trimethylammoniumethyl methacrylate methosulfate, $M_w$ 1000 to 500 000, Copolymers of 30 mol % acrylamide and 70 mol % trimethylammoniumethyl methacrylate methosulfate, $M_w$ 1000 to 1 000 000, Copolymers of 70 mol % acrylamide and 30 mol % dimethylaminoethyl methacrylamide, $M_w$ 1000 to 1 000 000, Copolymers of 50 mol % hydroxyethyl methacrylate and 50 mol % 2-dimethylaminoethyl methacrylamide, $M_w$ 1000 to 500 000.

It is also possible to incorporate minor amounts (<10% by weight) of anionic comonomers as polymerized units, e.g. acrylic acid, methacrylic acid, vinylsulfonic acid or alkali metal salts of said acids.

Copolymer of 70 mol % hydroxyethyl methacrylate and 30 mol % 2-dimethylaminoethylmethacrylamide; copolymer of 30 mol % vinylimidazole methochloride, 50 mol % dimethylaminoethyl acrylate, 15 mol % acrylamide, 5 mol % acrylic acid, polylysines having an $M_w$ of from 250 to 250 000, preferably 500 to 100 000, and lysine cocondensates having molar masses $M_w$ of from 250 to 250 000, the cocondensible component being, for example, amines, polyamines, ketene dimers, lactams, alcohols, alkoxylated amines, alkoxylated alcohols and/or nonprotogenic amino acids, vinylamine homopolymers, 1 to 99 mol % of hydrolyzed polyvinylformamides, copolymers of vinylformamide and vinyl acetate, vinyl alcohol, vinylpyrrolidone or acrylamide having molar masses of from 3 000 to 500 000, vinylimidazole homopolymers, vinylimidazole copolymers with vinylpyrrolidone, vinylformamide, acrylamide or vinyl acetate having molar masses of from 5 000 to 500 000, and quaternary derivatives thereof, polyethylenimines, crosslinked polyethylenimines or amidated polyethylenimines having molar masses of from 500 to 3 000 000, amine/epichlorohydrin polycondensates which contain, as amine component, imidazole, piperazine, $C_1$–$C_8$-alkylamines, $C_1$–$C_8$-dialkylamines and/or dimethylaminopropylamine and which have a molar mass of from 500 to 250 000, polymers containing basic (meth)acrylamide or (meth) acrylic ester units, polymers containing basic quaternary (meth)acrylamide or (meth)acrylic ester units and having molar masses of from 10 000 to 2 000 000.

In order to cationically modify anionically dispersed, particulate, hydrophobic polymers, the latter can, in addition to a treatment with cationic polymers, also be treated with polyvalent metal ions and/or cationic surfactants. Coating of the particles with polyvalent metal ions is achieved by, for example, adding an aqueous solution of at least one water-soluble, polyvalent metal salt to an aqueous dispersion of anionically dispersed hydrophobic polymers, or dissolving a water-soluble, polyvalent metal salt therein, the modification of the anionically dispersed hydrophobic particles which cationic polymers being carried out either before, at the same time as or after this treatment. Suitable metal salts are, for example, the water-soluble salts of Ca, Mg, Ba, Al, Zn, Fe, Cr or mixtures thereof. Other water-soluble heavy metal salts which are derived, for example, from Cu, Ni, Co and Mn can also in principle be used, but are not desired in all applications. Examples of water-soluble metal salts are calcium chloride, calcium acetate, magnesium chloride, aluminum sulfate, aluminum chloride, barium chloride, zinc chloride, zinc sulfate, zinc acetate, iron(II) sulfate, iron(III) chloride, chromium(III) sulfate, copper sulfate, nickel sulfate, cobalt sulfate and manganese sulfate. Preference is given to using the water-soluble salts of Ca, Mg, Al and Zn for the cationization.

The charge of the anionically dispersed hydrophobic polymers can also be changed using cationic polymers and cationic surfactants. Of potential suitability for this purpose are cationic surfactants of very different structures. An overview of a selection of suitable cationic surfactants is given in Ullmanns Encyclopaedia of Industrial Chemistry, Sixth Edition, 1999, Electronic Release, Chapter "Surfactants", Chapter 8, Cationic Surfactants.

Particularly suitable cationic surfactants are, for example, $C_7$–$C_{25}$-alkylamines, $C_7$–$C_{25}$-N,N-dimethyl-N-(hydroxyalkyl)ammonium salts, mono- and di-($C_7$–$C_{25}$)alkyldimethylammonium compounds quaternized with alkylating agents, ester quats, such as, for example, quaternary esterified mono-, di- or trialkanolamines which have been esterified with $C_8$–$C_{22}$-carboxylic acids, imidazoline quats, such as 1-alkylimidazolinium salts of the formulae IV or V:

(IV)

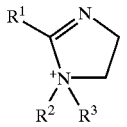

(V)

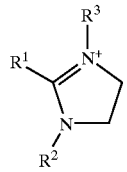

where $R^1$=$C_1$–$C_{25}$-alkyl or $C_2$–$C_{25}$-alkenyl, $R^2$=$C_1$–$C_4$-alkyl or hydroxyalkyl and $R^3$=$C_1$–$C_4$-alkyl, hydroxyalkyl or a radical $R^1$—CO—X—$(CH_2)_n$— where X=O or NH and n=2 or 3, and where at least one radical $R^1$=$C_7$–$C_{22}$-alkyl or $C_7$–$C_{22}$-alkenyl.

For many commercial applications and everyday domestic applications, the modification of the properties of textiles with dispersions is of significance. It is not always possible to carry out the modification of surfaces by impregnation, spraying and painting processes with concentrated dispersions. It is frequently desirable to carry out the modification using a rinsing of the textile material to be treated with a heavily diluted liquor containing an active substance or by spraying on a heavily diluted aqueous formulation. Here, it is often desirable to combine the modification of the surface of textiles in association with a washing, cleaning and/or care or impregnation of the surface. Particularly suitable textiles are cotton fabric and cotton blend fabric. In addition it is also possible to treat carpets and furniture coverings in accordance with the invention.

The modification of the surfaces of textile materials can consist, for example, in a hydrophobicization, soil release finishing, soil-repellancy finishing, a reinforcement of the fiber composite and protection against chemical or mechanical influences or damage.

The cationically modified, particulate, hydrophobic polymers are used for the modification of surfaces of the materials mentioned above by way of example, as additive to rinse or care compositions for textiles, and as detergents. They can, for example, be used as the sole active component in aqueous rinse and care compositions and, depending on the composition of the polymer, for example, facilitate soil release during a subsequent wash, bring about lower soil adhesion during use of the textiles, improve the structural retention of fibers, improve the retention of shape and structure of fabrics, effect hydrophobicization of the surface of the ware, and improve the handle. The concentration of the cationically modified, particulate, hydrophobic polymers in the case of use in a rinse or care bath, in the detergent liquor or the cleaning bath is, for example, 0.0002 to 1.0% by weight, preferably 0.0005 to 0.25% by weight, particularly preferably 0.002 to 0.05% by weight.

The treatment of laundry or textile surfaces is carried out using aqueous liquors which contain, for example, 2.5 to 300 ppm, preferably 5 to 200 ppm and in particular 10 to 100 ppm of at least one cationic polymer and optionally in addition up to 10 mmol/l, preferably up to 5 mmol/l, particularly preferably up to 3.5 mol/l, of water-soluble salts of polyvalent metals, in particular salts of Ca, Mg or Zn and/or up to 2 mmol/l, preferably up to 0.75 mmol/l, of water-soluble Al salts and/or up to 600 ppm, preferably up to 300 ppm, of cationic surfactants.

Compositions for the treatment of laundry and textile surfaces can be liquid, in gel form or solid.

The compositions may, for example, have the following composition:

(a) 0.05 to 40% by weight of cationically modified, particulate, hydrophobic polymers, the surface of which has been cationically modified by coating with cationic polymers, and the particle size of which is 10 nm to 100 μm, (b) 0.01 to 10% by weight of at least one cationic polymer, and (c) 0 to 80% by weight of at least one customary additive, such as acids or bases, inorganic builders, organic cobuilders, further surfactants, polymeric color transfer inhibitors, polymeric antiredeposition agents, soil release polymers, enzymes, complexing agents, corrosion inhibitors, waxes, silicone oils, light protection agents, dyes, perfume, solvents, hydrotropic agents, salts, thickeners and/or alkanolamines.

Laundry aftertreatment and laundry care compositions in liquid or gel form comprise, for example (a) 0.1 to 30% by weight of particulate, hydrophobic polymers which contain at least one group of anionic ethylenically unsaturated monomers in copolymerized form, have a particle size of from 10 nm to 100 μm and have been dispersed in water (b) 0.05 to 20% by weight of an acid, such as formic acid, citric acid, adipic acid, succinic acid, oxalic acid or mixtures thereof, (c) 0.1 to 10% by weight of at least one cationic polymer, (d) 0 to 30% by weight of at least one water-soluble salt of Mg, Ca, Zn or Al and/or of a cationic surfactant, (e) 0 to 10% by weight of at least one other customary ingredient, such as perfume, other surfactants, silicone oil, light protection agent, dyes, complexing agent, antiredeposition agent, soil release polyester, color transfer inhibitor, nonaqueous solvent, hydrotropic agent, thickener and/or alkanolamine and (f) water to make up to 100% by weight.

The above-described laundry aftertreatment and laundry care compositions can be formulated on the basis of the same ingredient or as solid compositions. Examples of possible solid forms are powders, granules and tablets.

To prepare solid compositions, it may be necessary to additionally add extenders, spraying agents, agglomeration auxiliaries, coating auxiliaries or binders. To ensure the action and good dissolution behavior, it may additionally be necessary to add components which aid dissolution, such as readily water-soluble salts, polymeric disintegrants or combinations of acids and hydrogencarbonate.

In a preferred embodiment, laundry aftertreatment and laundry care compositions comprise, as component (a), 0.5 to 25% by weight of particulate, hydrophobic polymers which contain, in copolymerized form, 25 to 60% by weight of an ethylenically unsaturated monomer which contains at least one carboxylic acid group, have a particle size of from 10 nm to 100 μm and have been dispersed using an anionic emulsifier and/or an anionic protective colloid in water.

The compositions of this preferred embodiment are particularly suitable for achieving soil-release-promoting properties. Soilings which arise in the service phase are more readily removed from laundry aftertreated in this way in the subsequent washing operation.

In a further preferred embodiment, laundry aftertreatment and laundry care compositions comprise, as component (a), 0.5 to 25% by weight of particulate, hydrophobic polymers which contain, in copolymerized form, 0.1 to 10% by weight of an ethylenically unsaturated monomer which contains at least one carboxylic acid group, and at least 80% by weight of a water-insoluble ethylenically unsaturated nonionic monomer, have a particle size of from 10 nm to 100 μm and have been dispersed using an anionic emulsifier and/or an anionic protective colloid in water.

The compositions of this preferred embodiment are particularly suitable for achieving hydrophobicizing or impregnating properties. Water is absorbed or let through by laundry aftertreated in this way to a significantly lesser extent.

Laundry aftertreatment and laundry care compositions comprise in a further prerferred embodiment, as component (a) 0.5 to 25% by weight of particulate, hydrophobic polymers which contain, in copolymerized form, 10 to 100% by weight of an ethylenically unsaturated monomer which contains fluorine substituents, have a particle size of from 10 nm to 100 μm and have been dispersed using an anionic emulsifier and/or an anionic protective colloid in water.

The compositions of this preferred embodiment are particularly suitable for achieving soil repellency properties, in particular oil and grease soil repellency properties. Oil and grease soiling is absorbed by fabric aftertreated in this way to a lesser extent.

Suitable acids are mineral acids, such as sulfuric acid or phosphoric acid, and organic acids, such as carboxylic acids or sulfonic acids. Strong acids, such as sulfuric acid, phosphoric acid, or sulfonic acids are usually used here in partially neutralized form.

The cationic modification of the particulate, hydrophobic polymers is preferably carried out prior to use in the aqueous treatment compositions, although it can also be carried out during the preparation of the aqueous treatment compositions or the use of anionically emulsified, particulate, hydrophobic polymers having a particle size of from 10 nm to 100 μm by, for example, mixing aqueous dispersions of the suitable particulate, hydrophobic polymers with the other constituents of the treatment composition in each case in the presence of cationic polymers and optionally water-soluble salts of polyvalent metals and/or cationic surfactants.

In a particular embodiment it is also possible to add the anionic particles or formulations containing these particles directly to the rinse, wash or cleaning liquor if it is ensured that sufficient amounts of cationic polymers and optionally polyvalent metal ions and/or cationic surfactants are present in the liquor in dissolved form. For example, it is possible to use the anionic hydrophobic particles or formulations containing these particles in liquors having a content of cationic polymers of from 2.5 to 300 ppm and optionally of water-soluble salts of Ca, Mg or Zn of more than 0.5 mmol/l, preferably more than 1 mmol/l, particularly preferably more than 2 mmol/l. If cationic surfactants are used, they are used, for example, in concentrations of from 50 to 100 ppm, preferably 75 to 500 ppm and in particular from 100 to 300 ppm, in the aqueous liquor.

The anionic particles or formulations containing these particles can also be metered in before, after or at the same time as a formulation containing cationic polymers and optionally cationic surfactants.

Examples of the composition of typical nonionic dispersions which can be processed to rinse and care compositions and detergents by mixing with cationic polymers and optionally water-soluble salts of polyvalent metals and/or cationic surfactants and also other components are the dispersions I to V described below, the dispersed particles of which can in each case be observed, upon investigation using an electron microscope, as discrete particles having the given average particle diameter:

Dispersion I

40% strength by weight aqueous dispersion of a polymer of 56% by weight of ethyl acrylate, 33% by weight of methacrylic acid and 11% by weight of acrylic acid having an average particle diameter of 288 nm. The dispersion comprised 1.25% by weight of an anionic surfactant as emulsifier and 20% by weight of a low molecular weight starch as protective colloid. It had a pH of 4.

Dispersion II

30% strength by weight aqueous dispersion of a polymer of 66% by weight of ethyl acrylate, 4% by weight of methacrylic acid, 26% by weight of acrylic acid and 4% by weight of acrylamide. The average diameter of the dispersed particles of the dispersion was 176 nm. The dispersion comprised 0.8% by weight of an anionic surfactant as emulsifier and had a pH of 4.

Dispersion III

30% strength by weight aqueous dispersion of a polymer of 50% by weight of ethyl acrylate and 50% by weight of methacrylic acid with an average diameter of the dispersed particles of 123 nm. The dispersion comprised 0.8% by weight of an anionic surfactant as emulsifier and had a pH of 4.

Dispersion IV

35% strength by weight dispersion of a polymer of 64% by weight of n-butyl acrylate, 33% by weight of methyl methacrylate and 4% by weight of acrylic acid. The average diameter of the dispersed particles of the dispersion was 80 nm. The dispersion comprised 1.5% by weight of an anionic surfactant as emulsifier and had a pH of 6.

Dispersion V

Anionic fluoropolymer dispersion Nuva® FTA-4 (Clariant)

Using dispersions I to III it is possible to prepare typical formulations with soil release action according to the invention which are used, for example, during domestic washing in the rinse cycle of the washing machine in a dose of from 0.5 to 5 g/l, preferably 1 to 3 g/l:

Formulation I

50% by weight of one of the above-described dispersions I to III 1.5% by weight of formic acid 0.5% by weight of polyethyleneimine of molar mass $M_w$ 25 000 water to make up to 100% by weight.

Formulation II

50% by weight of one of the above-described dispersions I to III 4.5% by weight of formic acid 5% by weight of calcium chloride 1.0% by weight of polyethyleneimine of molar mass $M_w$ 5 000 water to make up to 100% by weight.

Formulation III

50% by weight of one of the above-described dispersions I to III

2% by weight of 2N sulfuric acid 1.0% by weight of crosslinked high molecular weight polyethyleneimine 2.0% by weight of polyvinylpyrrolidone of molar mass $M_w$ 50 000 water to make up to 100% by weight.

Formulation IV

50% by weight of one of the above-described dispersions I to III

2% by weight of 2N sulfuric acid 0.5% by weight of polyethyleneimine of molar mass $M_w$ 25 000

5% by weight of an ester quat (methyl quat of the di-tallow fatty acid ester of triethanolamine)

water to make up to 100% by weight.

The formulations can optionally comprise further constituents such as customary soil release polymers for polyesters, antiredeposition agents, perfume, dyes, enzymes, hydrotropic agents, solvents, nonionic surfactants, silicone oil, a textile softener and/or a thickener.

Using dispersions IV and V it is possible to prepare typical formulations with impregnating effects according to the invention which are used, for example, during domestic washing in the rinse cycle of the washing machine in a dose of from 0.5 to 5 g/l, preferably 1 to 3 g/l.

Formulation V for Water Repellency Impregnation

50% by weight of the above-described dispersion IV

1% by weight of polyethyleneimine of molar mass $M_w$ 25 000

5% by weight of polyvinylpyrrolidone of molar mass $M_w$ 50 000 water to make up to 100% by weight

Formulation VI for Oil Repellency Impregnation

50% by weight of the above-described dispersion V 0.2% by weight of polyethyleneimine of molar mass $M_w$ 25 000

5% by weight of calcium acetate water to make up to 100% by weight

The formulations can optionally comprise further constituents such as customary soil release polymers for polyesters, antiredeposition agents, perfume, dyes, enzymes, hydrotropic agents, solvents, nonionic surfactants, silicone oil, a textile softener and/or a thickener.

The following aqueous dispersions of copolymers, the dispersed particles of which have an average diameter of from 10 nm to 100 $\mu$m and which have in each case been dispersed using an anionic dispersant, for example, are suitable as hydrophobicizing, soil-repelling or fiber reinforcing additive to rinse or care compositions, and detergents:

copolymers of butyl acrylate and styrene, copolymers of butyl acrylate and vinyl acetate and tetrafluoroethylene polymers.

The anionic character of the abovementioned dispersions may optionally be additionally established by polymerizing the polymers in the presence of small amounts (up to 10% by weight) of anionic monomers, such as acrylic acid, styrenesulfonic acid, vinylphosphonic acid or acrylamido-2-methylpropanesulfonic acid. These dispersions are preferably cationically modified by treatment with water-soluble cationic polymers, or the cationic modification of the dispersions is carried out during the preparation of the rinse or care compositions. The resulting cationically modified, particulate, hydrophobic polymers to be used according to the invention have, upon use in the rinse cycle of domestic washing machines, a hydrophobicizing, fiber reinforcing and soil repellancy action on the textiles treated therewith.

The invention further provides a solid detergent formulation which comprises:

(a) 0.05 to 20% by weight of cationically modified, particulate, hydrophobic polymers, the surface of which has been cationically modified by coating with cationic polymers and optionally additionally with polyvalent metal ions and/or cationic surfactants, and the particle size of which is 10 nm 20 to 100 $\mu$m, (b) 0.1 to 40% by weight of at least one nonionic, cationic and/or anionic surfactant, (c) 0 to 50% by weight of an inorganic builder, (d) 0 to 20% by weight of an organic cobuilder, and (e) 0 to 60% by weight of other customary ingredients, such as extenders, enzymes, perfume, other surfactants, complexing agents, corrosion inhibitors, bleaches, bleach activators, bleach catalysts, color transfer inhibitors, antiredeposition agents, soil release polyesters, dyes, dissolution improvers and/or disintegrants, and a detergent formulation in liquid or gel form which comprises (a) 0.05 to 20% by weight of cationically modified, particulate, hydrophobic polymers, the surface of which has been cationically modified by coating with at least one cationic polymer and optionally additionally with polyvalent metal ions and/or cationic surfactants, and the particle size of which is 10 nm to 100 $\mu$m, (b) 0.1 to 40% by weight of at least one nonionic, cationic and/or anionic surfactant, (c) 0 to 20% by weight of an inorganic builder, (d) 0 to 10% by weight of an organic cobuilder, (e) 0 to 20% by weight of other customary ingredients, such as soda, enzymes, perfume, other surfactants, complexing agents, corrosion inhibitors, bleaches, bleach activators, bleach catalysts, color transfer inhibitors, antiredeposition agents, soil release polyesters, dyes, nonaqueous solvents, hydrotropic agents, thickeners and/or alkanolamines and (f) 0 to 90% by weight of water.

The surfactants, builders, cobuilders, complexing agents, solvents, color transfer inhibitors, soil release polyesters, bleaches, bleach activators, antiredeposition agents, enzymes, perfumes, solvents, thickeners, oils, waxes, hydrotropic agents, foam suppressors, silicones, brighteners and dyes specified in the various formulations can be combined within the scope of the feed substances usually customary in dishwashing, care, laundry washing and cleaning formulations. For typical ingredients, reference may be made to the chapter Detergents (Part 3, Detergent Ingredients, Part 4, Household Detergents and Part 5, Institutional Detergents) in Ullmann's Encyclopedia of Industrial Chemistry, Sixth Edition, 2000 Electronic Version 2.0.

Preferred nonionic surfactants are, for example, alkoxylated $C_8$–$C_{22}$-alcohols, such as fatty alcohol ethoxylates and oxo alcohol alkoxylates which have been alkoxylated with 3 to 15 mol of ethylene oxide and optionally additionally with 1 to 4 mol of propylene oxide and/or butylene oxide, and also block polymers of ethylene oxide and propylene oxide with a molar mass of from 900 to 12 000 and a weight ratio of ethylene oxide to propylene oxide of from 1 to 20.

Particularly preferred nonionic surfactants are $C_{13}/C_{15}$ oxo alcohol ethoxylates and $C_{12}/C_{14}$ fatty alcohol ethoxylates which have been alkoxylated with 3 to 11 mol of ethylene oxide per mole of alcohol or firstly with 3 to 10 mol of ethylene oxide and then with 1 to 3 mol of propylene oxide per mole of alcohol.

Preferred anionic surfactants are, for example, alkylbenzenesulfonates with linear or branched $C_6$–$C_{25}$-alkyl groups, fatty alcohol and oxo alcohol sulfates with $C_8$–$C_{22}$-alkyl groups and fatty alcohol or oxo alcohol ether sulfates from $C_8$–$C_{22}$-alcohols which have been ethoxylated with 1 to 5 mol of ethylene oxide per mole of alcohol and have been sulfated on the OH end-group of the ethoxylate.

Formulations according to the invention are preferably formulated to have a low content of anionic surfactants, and are particularly preferably free from anionic surfactants. If anionic surfactants are used in the formulations, preference is given to using ether sulfates.

Preferred solvents are alcohols, such as methanol, ethanol, isopropanol, n-butanol, isobutanol, ethylene glycol, propylene glycol, diethylene glycol, triethylene glycol, dipropylene glycol, tripropylene glycol and butanediol.

Preferably, only small amounts of, and particularly preferably no, solvents are added to the formulations.

Preferred builders are alkali metal carbonates, phosphates, polyphosphates, zeolites and silicates. Particularly preferred builders are zeolite A, zeolite P, phyllosilicates, soda and trisodium polyphosphate.

Preferred complexing agents are nitrilotriacetic acid, methylglycinediacetic acid and ethylenediamine tetraacetate.

Preferred cobuilders are acrylic acid homopolymers, acrylic acid/maleic acid copolymers, polyaspartic acid and citric acid. Particularly preferred cobuilders are acrylic acid homopolymers of molar mass 1 500 to 30 000 and acrylic acid/maleic acid copolymers with a molar ratio of the monomers of from 10:1 to 1:2 and molar masses of from 4 000 to 100 000.

Preferred soil release polyesters are polyesters of terephthalic acid, ethylene glycol and polyethylene glycol, where polyethylene glycols with molar masses of from 1 000 to 5 000 are incorporated by condensation, and also those polyesters in which terephthalic acid has been replaced in an amount up to 50 mol % by sulfocarboxylic acids or sulfodicarboxylic acids.

Preferred color transfer inhibitors are polyvinylpyrrolidone of molar masses 8 000 to 70 000, vinylimidazole/vinylpyrrolidone copolymers with a molar ratio of the monomers of from 1:10 to 2:1 and molar masses of from 8 000 to 70 000, and poly-4-vinylpyridine N-oxides of molar masses from 8 000 to 70 000.

Preferred enzymes are proteases, lipases, cellulases and amylases.

Formulations according to the invention can optionally additionally comprise further protective colloids for stabilizing the disperse state. This is of particular importance particularly in the case of liquid formulations in order to prevent coagulation. The protective colloids can, however, also be added advantageously to solid formulations in order to prevent coagulation during use.

Protective colloids which may be used are water-soluble polymers, in particular water-soluble nonionic polymers. Suitable protective colloids preferably have molar masses of from 8 000 to 200 000, particularly preferably from 5 000 to 75 000, in particular from 10 000 to 50 000.

Suitable protective colloids are, for example, polyvinylpyrrolidone, polyethylene glycol, block polymers of ethylene oxide and propylene oxide, enzymatically degraded starches and polyacrylamides.

Use of the cationically modified dispersions to be used according to the invention achieves, particularly on cotton and cellulose fibers, a significantly higher soil release action than with known water-soluble soil release polymers.

The percentages in the examples are percentages by weight.

EXAMPLES

For the examples and comparative examples, the dispersion I was used.

Dispersion I

40% strength by weight aqueous dispersion of a polymer of 56% by weight of ethyl acrylate, 33% by weight of methacrylic acid and 11% by weight of acrylic acid having an average particle diameter of 288 nm. The dispersion comprised 1.25% by weight of an anionic surfactant as emulsifier and 20% by weight of a low molecular weight starch as protective colloid. It had a pH of 4.

Comparative Example 1

The anionic dispersion I was brought to a content of 0.040% using deionized water of pH 4. A white cotton fabric was suspended in the magnetically stirred liquor for 30 min. The absorbance of the liquor was measured at 520 nm using a vis-spectrometer. Over the course of 30 min, no change in the absorbance was observed. Electron micrographs showed virtually no coating of the cotton fibers with dispersion particles.

Example 1

The dispersion I was brought to a content of particles of 10% by weight using deionized water of pH 4. This dispersion was metered in, with stirring using a magnetic stirrer, to an equal volume of a 1% strength solution, adjusted to pH 4, of a high molecular weight crosslinked polyethylenimine (molar mass 2 000 000) over the course of 30 min. This gave a dispersion which was stable for hours.

This dispersion was diluted to a content of 0.040% using deionized water of pH 4. A white cotton fabric was suspended in the magnetically stirred liquor for a period of 30 min. The absorbance of the liquor was measured at 520 nm using a vis-spectrometer over 30 minutes. A considerable decrease in absorbance was observed.

Example 2

Example 1 was repeated except that the cationic polymer used for coating the dispersion particles was a copolymer of vinylimidazole and vinylpyrrolidone (monomer ratio 1:1) of molar mass 10 000.

Example 3

Example 1 was repeated except that the cationic polymer used for coating the dispersion particles was a polycondensate of imidazole and epichlorohydrin (molar ratio of the components 1:1) of molar mass 12 000.

TABLE 1

Absorbance of the dispersions measured at 520 nm in a 1 cm cell. The values give the absorbance of the diluted dispersion prior to emersion of the cotton fabric and after 30 minutes.

| Measurement time point | Comparative Example 1 | Example 1 | Example 2 | Example 3 |
|---|---|---|---|---|
| t = 0 min | 1.0 | 0.99 | 0.99 | 1.00 |
| t = 30 min | 1.0 | 0.65 | 0.77 | 0.69 |

A comparison of Examples 1 to 3 with the Comparative Example 1 shows that, where the particles are coated with the cationic polymers, considerably higher proportions of the hydrophobic particles are adsorbed on the surface of the cotton fabric than in the absorbance of the cationic polymers. This finding is confirmed by electron micrographs.

Examples 4 to 6 and Comparative Examples 2 to 4

To test the soil release properties of afterrinse formulations containing particles according to the invention, the following washing experiments were carried out:

Cotton fabric was prewashed with dispersion I. In comparative experiment 3, the dispersion was used in the absence of a cationic polymer. In Examples 4 to 6, the dispersion particles were firstly coated with 10% by weight of the cationic polymers as described in Examples 1 to 3. The prewashed fabrics were soiled with lipstick composition and then washed with a standard detergent (Ariel Futur). To evaluate the soil release action, the reflectance of the soiled fabric was measured before and after washing and from this, in a known manner together with the reflectance value of the white cotton fabric, the soil release was determined in % soil release.

Washing Conditions
Prewash
Washing device: Launder-O-meter
Prewash temperature: 20° C.
Prewash time: 15 min
Main Wash:
Wash temperature: 40° C.
Wash time: 30 min
Water hardness: 3 mmol/l
Ca/Mg ratio: 3:1

TABLE 2

Washing results:

| | Comparative Example | Comparative Example 3 | Comparative Example 4 | Example 4 | Example 5 | Example 6 |
|---|---|---|---|---|---|---|
| Concentration of particles from dispersion I in the prewash | 0 | 400 mg/l | 0 | 400 mg/l | 400 mg/l | 400 mg/l |
| Cationic polymer | none | none | PEI | PEI | PVI/VP | Imidazole/epi |
| Soil release action in the subsequent wash in % soil release | 32 | 33 | 30 | 52 | 49 | 50 |

The abbreviations in the table have the following meanings:
PET: Polyethylenimine
PVI/VP: Copolymer of vinylimidazole and N-vinylpyrrolidone
Imidazole/epi: Condensate of imidazole and epichlorohydrin
The results of the washing experiments show that neither the anionic polymer dispersion alone nor the cationic polymer alone have a soil release action on the soiling. By contrast, the anionic polymer dispersions coated according to the invention with cationic polymers display a significant improvement in the soil release from cotton.

Example 7

The dispersion IV was brought to a content of particles of 0.4% by weight using deionized water of pH 6. This dispersion was metered in, with stirring, to an equal value of a 0.02% strength by weight solution, adjusted to pH 4, of polyethylenimine of molar mass $M_w$ 25 000 over the course of 30 min. This gave a stable dispersion.

Example 8

To test the water repellency properties of cotton fabrics which have been achieved using rinse formulations according to the invention, washing experiments were carried out in the Launder-O-meter. Cotton fabric was washed with a standard commercial detergent and, in the rinse cycle, rinsed with the cationically modified dispersion from example 7. In comparative example 5, no dispersion was added to the rinse bath. In comparative experiment 6, the non-cationically modified dispersion IV was added. The rinsed fabric was spun, dried and ironed. To test the water repellency effect, the fabric was laid flat over the opening of a beaker with a diameter of 5 cm. One droplet of water was applied centrally. The time until the drop had completely penetrated into the fabric was determined.

Washing Conditions:
Main Wash:
Detergent: Ariel Futur
Detergent dose: 3.5 g/l
Wash time: 30 min
Wash temperature: 40° C.
Water hardness: 3 mmol/l
Ca/Mg ratio: 3:1
Rinsing:
Rinse temperature: 20° C.
Rinse time: 15 min
pH: 6
Liquor ratio: 12.5

TABLE 3

| | Washing results | | |
|---|---|---|---|
| | Comparative example 5 | Comparative example 5 | Example 8 |
| Concentration of the dispersion from example 7 in the rinse cycle | — | — | 400 ppm |
| Concentration of the dispersion IV in the rinse cycle | — | 400 ppm | — |
| Penetration time for the water drop | 3 sec | 12 sec | 350 sec |

We claim:

1. A composition for the treatment of laundry and textile surfaces, which comprises:

(a) 0.05 to 40% by weight of cationically modified, particulate, hydrophobic polymers, the surface of which has been cationically modified by coating with cationic polymers, and the particle size of which is 10 nm to 100 $\mu$m, (b) 0.01 to 10% by weight of at least one cationic polymer, and (c) 0 to 80% by weight of at least one customary additive, such as acids or bases, inorganic builders, organic cobuilders, surfactants, polymeric color transfer inhibitors, polymeric antiredeposition agents, soil release polymers, enzymes, complexing agents, corrosion inhibitors, waxes, silicone oils, light protection agents, dyes, perfume, solvents, hydrotropic agents, salts, thickeners and/or alkanolamines.

2. A laundry aftertreatment and laundry care composition in liquid or gel form, which comprises:

(a) 0.1 to 30% by weight of particulate, hydrophobic polymers which contain at least one group of anionic ethylenically unsaturated monomers in copolymerized form, have a particle size of from 10 nm to 100 $\mu$m and have been dispersed in water, (b) 0.05 to 20% by weight of an acid, (c) 0.1 to 10% by weight of at least one cationic polymer, (d) 0 to 30% by weight of at least one water-soluble salt of Mg, Ca, Zn or Al and/or of a cationic surfactant, (e) 0 to 10% by weight of at least one other customary ingredient, such as perfume, other surfactants, silicone oil, light protection agent, dyes, complexing agent, antiredeposition agent, soil release polyester, color transfer inhibitor, nonaqueous solvent, hydrotropic agent, thickener and/or alkanolamine and (f) water to make up to 100% by weight.

3. A laundry aftertreatment and laundry care composition as claimed in claim 2, which comprises, as component (a), 0.5 to 25% by weight of particulate, hydrophobic polymers which contain, in copolymerized form, 25 to 60% by weight of an ethylenically unsaturated monomer which contains at least one carboxylic acid group, have a particle size of from 10 nm to 100 $\mu$m and have been dispersed using an anionic emulsifier and/or an anionic protective colloid in water.

4. A laundry aftertreatment and laundry care composition as claimed in claim 2, which comprises, as component (a), 0.5 to 25% by weight of particulate, hydrophobic polymers which contain, in copolymerized form, 0.1 to 10% by weight of an ethylenically unsaturated monomer which contains at least one carboxylic acid group and at least 80% by weight of a water-insoluble ethylenically unsaturated nonionic monomer, have a particle size of from 10 nm to 100 $\mu$m and have been dispersed using an anionic emulsifier and/or an anionic protective colloid in water.

5. A laundry aftertreatment and laundry care composition as claimed in claim 2, which comprises, as component (a), 0.5 to 25% by weight of particulate, hydrophobic polymers which contain, in copolymerized form, 10 to 100% by weight of an ethylenically unsaturated monomer containing fluorine substituents, have a particle size of from 10 nm to 100 $\mu$m and have been dispersed using an anionic emulsifier and/or an anionic protective colloid in water.

6. A solid detergent formulation which comprises:

(a) 0.05 to 20% by weight of cationically modified, particulate, hydrophobic polymers, the surface of which has been cationically modified by coating with cationic polymers and optionally additionally with polyvalent metal ions and/or cationic surfactants, and the particle size of which is 10 nm to 100 $\mu$m, (b) 0.1 to 40% by weight of at least one nonionic, cationic and/or anionic surfactant, (c) 0 to 50% by weight of an inorganic builder, (d) 0 to 10% by weight of an organic cobuilder, and (e) 0 to 60% by weight of other customary ingredients, such as extenders, enzymes, perfume, other surfactants, complexing agents, corrosion inhibitors, bleaches, bleach activators, bleach catalysts, color transfer inhibitors, antiredeposition agents, soil release polyesters, dyes, dissolution improvers and/or disintegrants.

7. A detergent formulation in liquid or gel form which comprises:

(a) 0.05 to 20% by weight of cationically modified, particulate, hydrophobic polymers, the surface of which has been cationically modified by coating with at least one cationic polymer and optionally additionally with polyvalent metal ions and/or cationic surfactants, and the particle size of which is 10 nm to 100 $\mu$m, (b) 0.1 to 40% by weight of at least one nonionic, cationic and/or anionic surfactant, (c) 0 to 20% by weight of an inorganic builder, (d) 0 to 10% by weight of an organic cobuilder, (e) 0 to 10% by weight of other customary ingredients, such as soda, enzymes, perfume, other surfactants, complexing agents, corrosion inhibitors, bleaches, bleach activators, bleach catalysts, color transfer inhibitors, antiredeposition agents, soil release polyesters, dyes, nonaqueous solvents, hydrotropic agents, thickeners and/or alkanolamines and (f) 0 to 90% by weight of water.

8. A method comprising:

treating a textile by contacting the textile with a mixture comprising one or more cationically modified particulate hydrophobic polymers having a cationically modified surface, wherein the cationically modified particulate hydrophobic polymers are obtained by coating one or more particulate hydrophobic polymers with one or more cationic polymers, wherein the particle size of the particulate hydrophobic polymers is from 10 nm to 100 $\mu$m.

9. The method as claimed in claim 8, wherein the cationically modified particulate hydrophobic polymers are obtained by treating an aqueous dispersion of the particulate hydrophobic polymers with an aqueous solution or dispersion of one or more cationic polymers.

10. The method of claim 9, wherein the aqueous dispersion comprises an anionic emulsifier, an anionic protective colloid or a mixture thereof.

11. The method of claim 8, wherein the particulate hydrophobic polymers comprise at least one copolymerized anionic monomer.

12. The method of claim 8, wherein a 0.1% strength by weight aqueous dispersion of the cationically modified particulate hydrophobic polymers has an interface potential of from −5 to +50 mV.

13. The method of claim 8, wherein the mixture is an aqueous dispersion of the cationically modified particulate hydrophobic polymers having a pH of from 2 to 12.

14. The method of claim 8, wherein the cationically modified particulate hydrophobic polymers are present in an amount of from 0.0002 to 1.0% by weight.

15. The method of claim 8, wherein the cationically modified particulate hydrophobic polymers are present in an amount of from 0.0002 to 0.05% by weight.

16. The method as claimed in claim 8, wherein the cationic polymers are selected from the groups consisting of polymers containing vinylamine units, polymers containing vinylimidazole units, polymers containing quaternary vinylimidazole units, condensates of imidazole and epichlorohydrin, crosslinked polyamido amines, crosslinked polyamidoamines grafted with ethylenimine, polyethylenimines, alkoxylated polyethylenimines, crosslinked polyethylenimines, amidated polyethylenimines, alkylated polyethylenimines, polyamines, amine/epichlorohydrin polycondensates, alkoxylated polyamines, polyallylamines, polydimethyldiallylammonium chlorides, polymers containing basic (meth) acrylamide esters, polymers containing (meth)acrylic esters, polymers containing basic quaternary (meth)acrylamide units, polymers containing (meth)acrylic ester units, lysinc condensates and mixtures thereof.

17. The method of claim 8, wherein the cationically modified particulate hydrophobic polymers are further modified by coating with one or more polyvalent metal ions, cationic surfactants or mixture thereof.

* * * * *